US008468651B2

(12) United States Patent
Lautenschläger

(10) Patent No.: US 8,468,651 B2
(45) Date of Patent: Jun. 25, 2013

(54) DAMPING DEVICE FOR FURNITURE DOOR LEAVES

(76) Inventor: Horst Lautenschläger, Reinheim (DE)

( * ) Notice: Subject to any disclaimer, the term of this patent is extended or adjusted under 35 U.S.C. 154(b) by 517 days.

(21) Appl. No.: 12/699,908

(22) Filed: Feb. 4, 2010

(65) Prior Publication Data

US 2010/0192327 A1 Aug. 5, 2010

(30) Foreign Application Priority Data

Feb. 4, 2009 (DE) ..... 10 2009 007 416

(51) Int. Cl.
*E05F 5/02* (2006.01)

(52) U.S. Cl.
USPC ..... 16/82; 16/83

(58) Field of Classification Search
USPC ..... 16/82–86 C; 312/328, 323, 319.2
See application file for complete search history.

(56) References Cited

U.S. PATENT DOCUMENTS 615,034 A * 11/1898 Merrill ..... 16/85
621,669 A * 3/1899 Hinds ..... 16/84
652,746 A * 7/1900 Colburn ..... 16/84
784,093 A * 3/1905 Adam ..... 16/84
1,044,412 A * 11/1912 Newton ..... 16/85
1,329,313 A * 1/1920 Seabury et al. ..... 16/85
1,966,956 A * 7/1934 Dunn ..... 16/84
2,024,100 A * 12/1935 Kahn ..... 16/86 A
2,074,008 A * 3/1937 Wolf ..... 16/84
2,542,140 A * 2/1951 Holm ..... 16/84
5,689,853 A * 11/1997 Lemmer ..... 16/82
6,408,483 B1 * 6/2002 Salice ..... 16/85
6,553,617 B1 * 4/2003 Salice ..... 16/85
7,194,785 B2 * 3/2007 Li ..... 16/85
7,207,087 B2 * 4/2007 Salice ..... 16/374
7,234,569 B2 * 6/2007 Salice ..... 16/85
7,275,284 B2 * 10/2007 Lautenschlager et al. ..... 16/287
7,340,799 B2 * 3/2008 Salice ..... 16/84
7,562,416 B2 * 7/2009 Lautenschlager et al. ..... 16/286
7,657,970 B2 * 2/2010 Artsiely ..... 16/85
7,814,618 B2 * 10/2010 Lautenschlager ..... 16/286
7,886,408 B2 * 2/2011 Lautenschlager ..... 16/286
2003/0141638 A1 * 7/2003 Salice ..... 267/34
2004/0181903 A1 * 9/2004 Salice ..... 16/82
2004/0200034 A1 * 10/2004 Salice ..... 16/84
2004/0231099 A1 * 11/2004 Li ..... 16/85
2005/0144758 A1 * 7/2005 Herper et al. ..... 16/277
2007/0251052 A1 * 11/2007 Pyo ..... 16/86 A
2008/0168620 A1 * 7/2008 Hammerle ..... 16/85
2008/0295283 A1 * 12/2008 Tice ..... 16/84
2009/0083939 A1 * 4/2009 Wu ..... 16/85
2009/0229076 A1 * 9/2009 Lautenschlager ..... 16/84
2009/0229077 A1 * 9/2009 Lautenschlager ..... 16/84
2009/0307869 A1 * 12/2009 Salice ..... 16/85
2011/0094055 A1 * 4/2011 Domenig et al. ..... 16/83
2011/0094056 A1 * 4/2011 Lautenschlager ..... 16/84

* cited by examiner

*Primary Examiner* — Jeffrey O Brien
(74) *Attorney, Agent, or Firm* — WRB-IP LLP

(57) ABSTRACT

A damping device furniture door leaves includes a damper housing with a base plate whose base area rests against and is fastened to an effective bearing area of the door opening of the furniture door leaf. The base plate includes a screw bore through which a fastening screw can be screwed into the effective bearing area. A spring projection extending from the base area of the base plate can be pushed behind the base area against spring resistance.

11 Claims, 4 Drawing Sheets

DAMPING DEVICE FOR FURNITURE DOOR LEAVES

BACKGROUND AND SUMMARY

The invention relates to a damping device for furniture door leaves with a damper accommodating damper housing having a base plate whose base area rests against and is fastened to an effective bearing area of the door opening of the furniture door leaf, with a front retaining projection that is angled off the base area overlapping the face edge of the effective bearing area.

Different embodiments of damping devices for furniture door leaves are known. At the end of the closing motion, the furniture door leaf makes contact with the damping device, either with the piston rod of the damper fixed inside the damper housing or with the cylinder housing of the damper that is guided for movement inside the damper housing and whose piston rod supports itself on the damper housing. The furniture door leaf that makes contact with the damping device is slowed down until it is completely closed so that there is no undesirable sudden. forceful contact of the furniture door leaf with the body of the piece of furniture.

A known damping device (EP 1 469 153 B1) is arranged in one corner of a body of a piece of furniture. A front flange of the damper housing forms a retaining projection that is angled off the base area of the damper housing with the retaining projection overlapping the two face edges of the effective bearing areas that meet in the corner of the body of the piece of furniture. This is where the damper housing is fastened to the body of the piece of furniture in a manner that is not described in detail.

Since the forces that act on the damping device can be relatively strong, and since limiting the arrangement of the damping device to the corner of the body of the piece of furniture substantially limits the number of possible uses and in particular the number of possible adjustments, it is desirable to provide a damping device as the type described in the introduction that can easily be fastened to any location on the edge of the door opening of the body of a piece of furniture so that even relatively strong forces can be absorbed.

In an aspect of the present invention, the base plate has a screw bore through which a fastening screw can be screwed into the effective bearing area and in that a spring projection protruding from the base area of the base plate can be pushed back behind the base area against spring resistance.

The spring projection that extends from the base area of the base plate when no forces act on it, facilitates the attachment of the damping device to a face frame of the body of a piece of furniture. This results in the inside edge of the face frame being accommodated between the front retaining projection that is fixed to the base plate and the back spring projection. This ensures that the damping device is aligned on the face frame.

A fastening screw is used to screw the base plate to the effective bearing area of the face frame, providing a very strong basis for the damping device.

If the damping device is used in a piece of furniture without a face frame, the base plate rests against the effective bearing area of the body of the piece of furniture with the entire length of its base area. The spring projection initially protruding from the base area is pushed back against spring resistance behind the base area when the base plate is screwed on and thus does not interfere when the base plate is screwed on.

This ensures that the damping device can be used either on face frames or on areas of the bodies of pieces of furniture without face frame without requiring any changes to the design and thus it can be used for two different types of furniture construction. It is not necessary to provide different damping devices or base plates for these two different types of furniture construction.

The spring projection can be angled off the free end of a spring tongue that is connected to the base plate and preferably is integrally formed with it. This embodiment is particularly simple from a manufacturing point of view because the spring tongue can be formed by a substantially U-shaped incision in the base plate and the spring projection is comprised of the angled end of this spring tongue.

According to a different, particularly advantageous embodiment of the invention, the spring projection is arranged on a plastic insert that is attached to the base plate. Here, the desired spring effect is exclusively reached by the material properties of the plastic insert so that the spring effect must not be taken into consideration when selecting the material and the construction type of the base plate. In particular this makes it possible to make the base plate relatively stiff.

It is particularly expedient when the plastic insert comprises a screw sleeve that provides the screw bore with the screw sleeve being connected to the spring projection via a spring arm. Since the screw sleeve is connected to the base plate when it is screwed in, this results in a simple design for fastening the spring projection carrying spring arm on the base plate without requiring any special measures.

It is particularly expedient when the screw sleeve has a bore that is adapted to the screw diameter so that the fastening screw can be pre-mounted in the screw sleeve. This would make it possible to pre-assemble the entire damping device with a captive fastening screw.

The spring projection expediently has two spring arms on the sides that extend toward the retaining projection when they are not deformed. When the damping device is fastened to a face frame, these spring arms on the sides make contact with the back of the face frame and thus cause a tolerance compensation for the width of the face frame across a comparatively large tolerance area.

BRIEF DESCRIPTION OF THE DRAWINGS

The invention is explained in more detail based on the following exemplary embodiments that are shown in the drawing. The following is shown.

DETAILED DESCRIPTION

Figure 1:
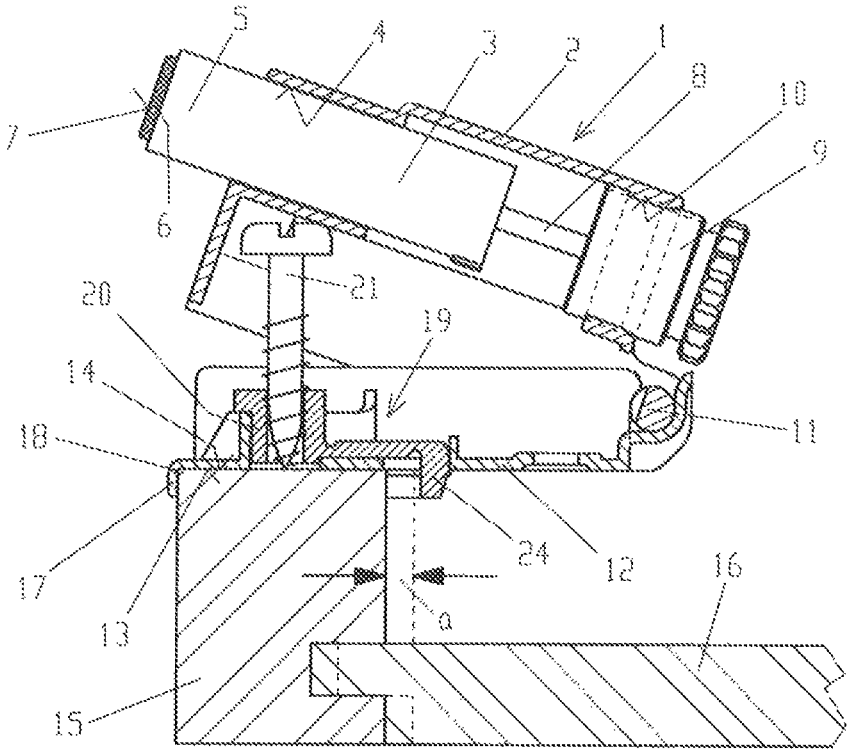
FIG. 1 shows a profile of a pre-mounted damping device for furniture door leaves on a face frame.
Figure 2:
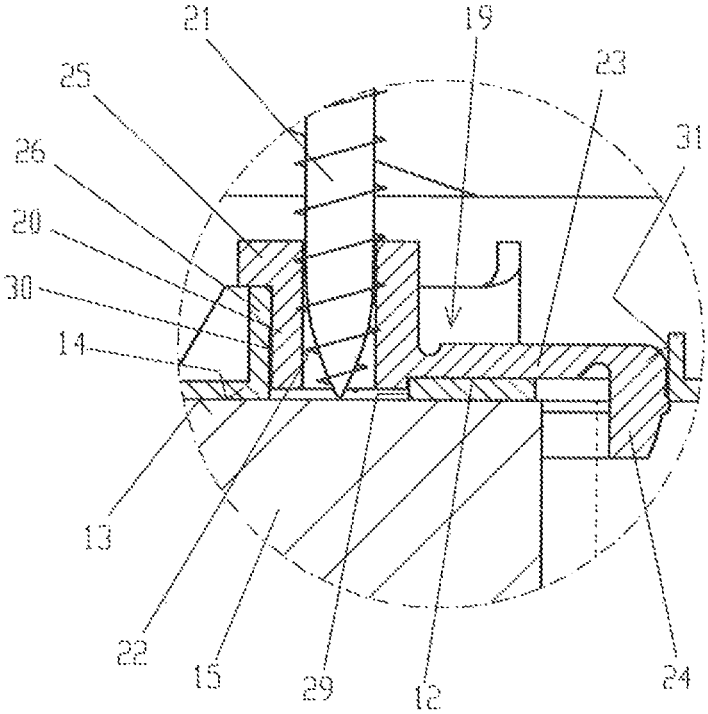
FIG. 2 shows an enlarged section of FIG. 1.

The damping device 1 shown in FIGS. 1-6 comprises a damper 3 in a damper housing 2. In the embodiment shown the damper housing 2 accommodates a damper cylinder 5 in a bore 4 in a longitudinally moveable manner. A face area 7 with a cushion 6 of the damper cylinder 5 forms a stop area for the furniture door leaf (not shown) that is to be dampened.

A piston rod 8 of the damper 3 is accommodated in the damper housing 2 via an adjusting screw 9. The adjusting screw 9 is screwed into a threaded bore 10 of the damper housing 3 and can be adjusted.

The damper 3, which is a fluid damper, counteracts the closing motion of the furniture door leaf with a damping force that is determined by speed.

The damper housing 2 comprises a base plate 12 that is connected via a joint 11 with the base area 13 of the base plate resting on an effective bearing area 14 of the door opening of the furniture door leaf. In the exemplary embodiment shown in FIG. 1 the effective bearing area 14 is comprised of the inside area of a face frame 15 that limits the door opening with the face frame being attached to the front of a body of a piece of furniture 16 in a piece of furniture that is based on the so-called "face-frame" construction design.

A front retaining projection 17 angled off the base area 13 of the base plate 12 overlaps the face edge 18 of the effective bearing area 14.

A plastic insert 19 fastened to the base plate 12 comprises a screw sleeve 20 which accommodates a fastening screw 21 in a screw bore 22 in a pre-assembled state. The diameter of the screw bore 22 is adjusted to the screw diameter of the fastening screw 21 so that the fastening screw 21 is retained in the screw sleeve 20 in a pre-assembled state and can be screwed into the face frame 15 from this position.

The screw sleeve 20 is connected to a spring projection 24 in an integrally formed manner via a spring arm 23 that extends from the base area 3 in the unstressed state shown in FIG. 1.

The screw sleeve 20 comprises an upper collar 25 (FIG. 2) that supports itself against a support edge 26 of the base plate 12. When the fastening screw 21 is screwed in, its screw head pushes against the collar 25 and in this manner fixes the base plate 12 together with the plastic insert 19 on the face frame 15.

Figure 3:
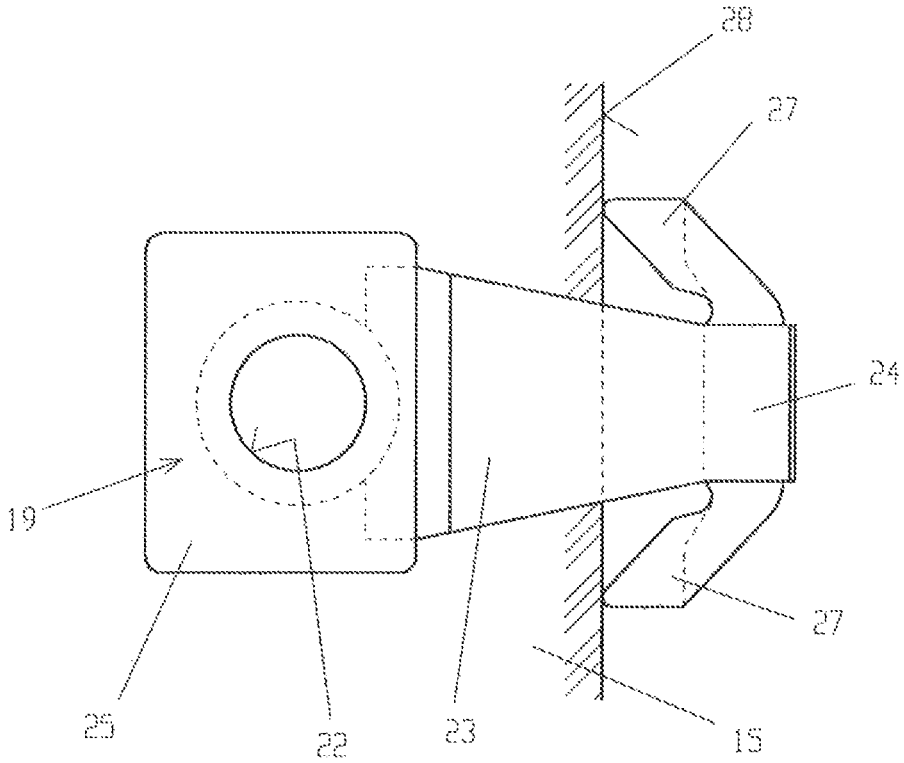
FIG. 3 shows an enlarged top view on the plastic insert in FIG. 1.
Figure 4:
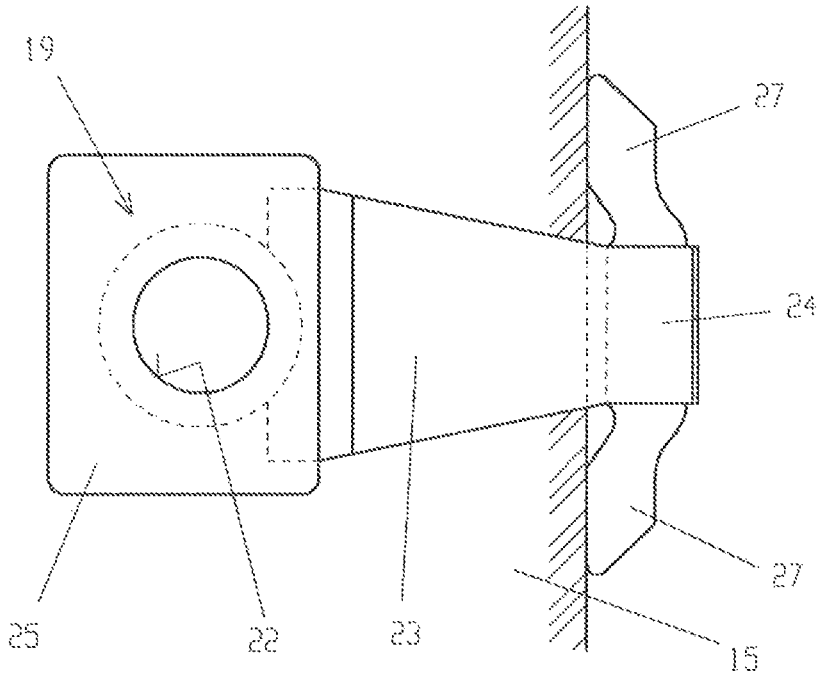
FIG. 4, in a presentation identical to FIG. 3, shows the plastic insert while used on a thick face frame, FIG. 5, in a presentation identical to FIG. 1, shows the pre-mounted damping device arranged on an inside area of a body of a piece of furniture.

The spring projection 24 comprises two spring arms 27 FIG. 3) on the sides that extend towards the front retaining projection 17 when they are not deformed. When the damping device is attached to the face frame 15, the spring arms 27 on the sides rest on the back 28 of the face frame 15. Due to their spring effect the spring arms 27 can be deformed in varying degrees so that it is possible to attach them to face frames 15 with different widths. This provides tolerance compensation over a relatively wide area a (FIG. 1) as can be seen when comparing FIG. 3 with FIG. 4.

The screw sleeve 20 extends through a bore 29 of the base plate 12. The plastic insert 19 is retained between a first support area 30 resting on the screw sleeve 20 and a second support area 31 of the base plate 12 resting on a spring projection 24. This fixes the plastic insert 19 in the base plate 12 in a pre-assembled state.

Figure 5:
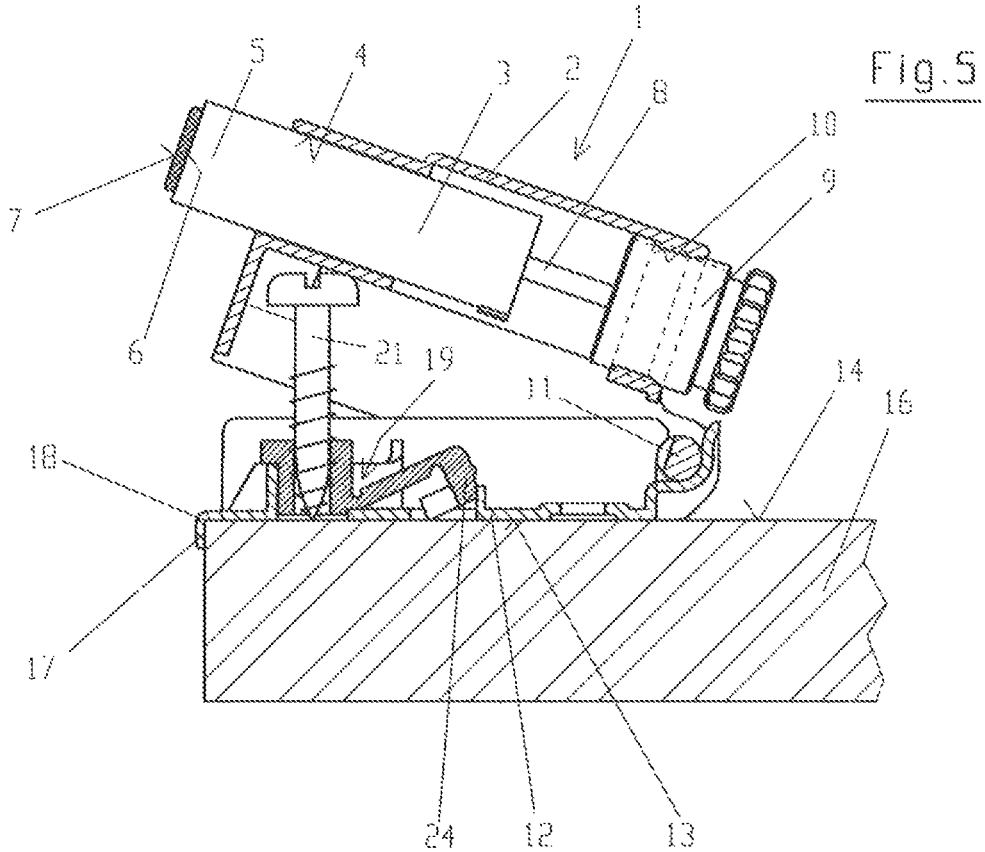
Figure 6:
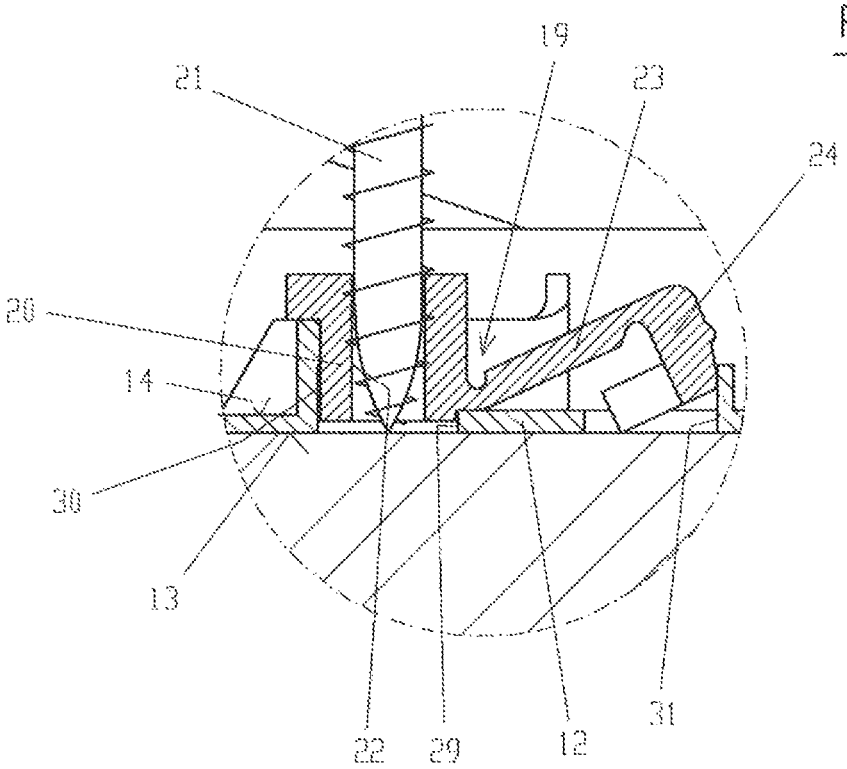
FIG. 6 shows an enlarged section from FIG. 5 in the area of the plastic insert, FIG. 7, in a presentation identical to FIG. 1, shows a modified embodiment of a pre-mounted damping device on an inside wall of a body of a piece of furniture and FIG. 8, in a presentation identical to FIG. 7, shows the arrangement of the damping device on a face frame.

In the exemplary embodiment shown in FIG. 5 the damping device 1 is arranged on an inside wall of the body of the furniture piece 16 without face frame that forms the effective bearing area 14. The spring projection 24 that extends from the base area 13 of the base plate 12 when it is not deformed, in the process is resiliently pushed back behind the base area 13 by the effective bearing area 14 and thus does not get in the way when it is attached to the smooth and continuous effective bearing area 14.

The damping device 1 shown in FIGS. 1-6 therefore can either be attached to furniture pieces with face frame 15 (FIG. 1) or without face frame (FIG. 5).

Figure 7:
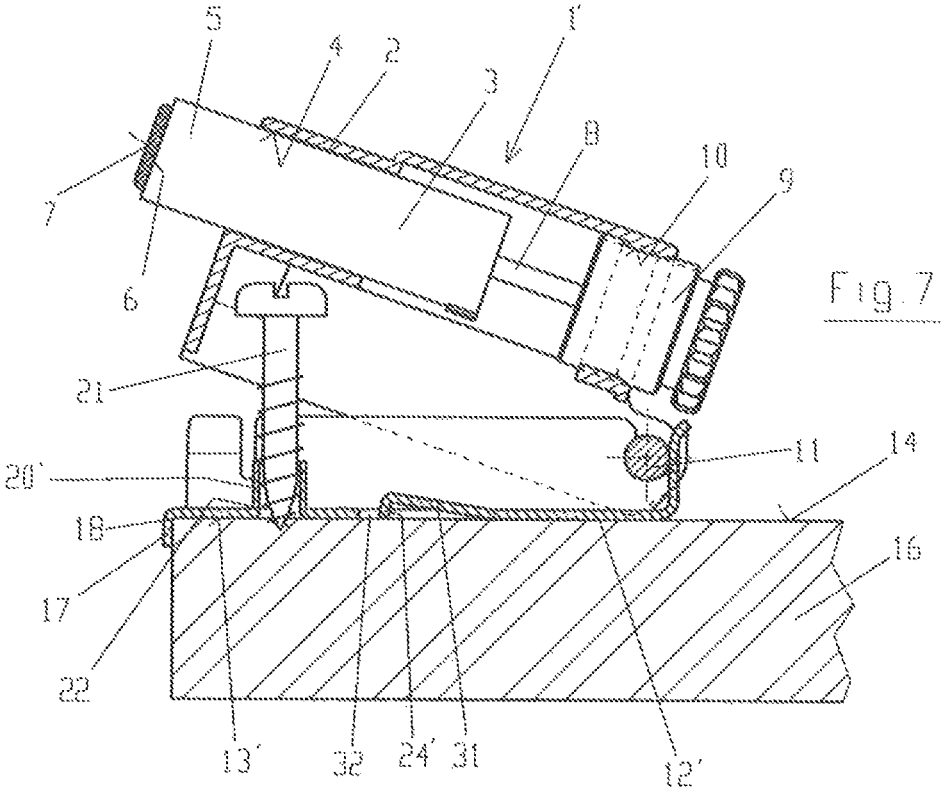
Figure 8:
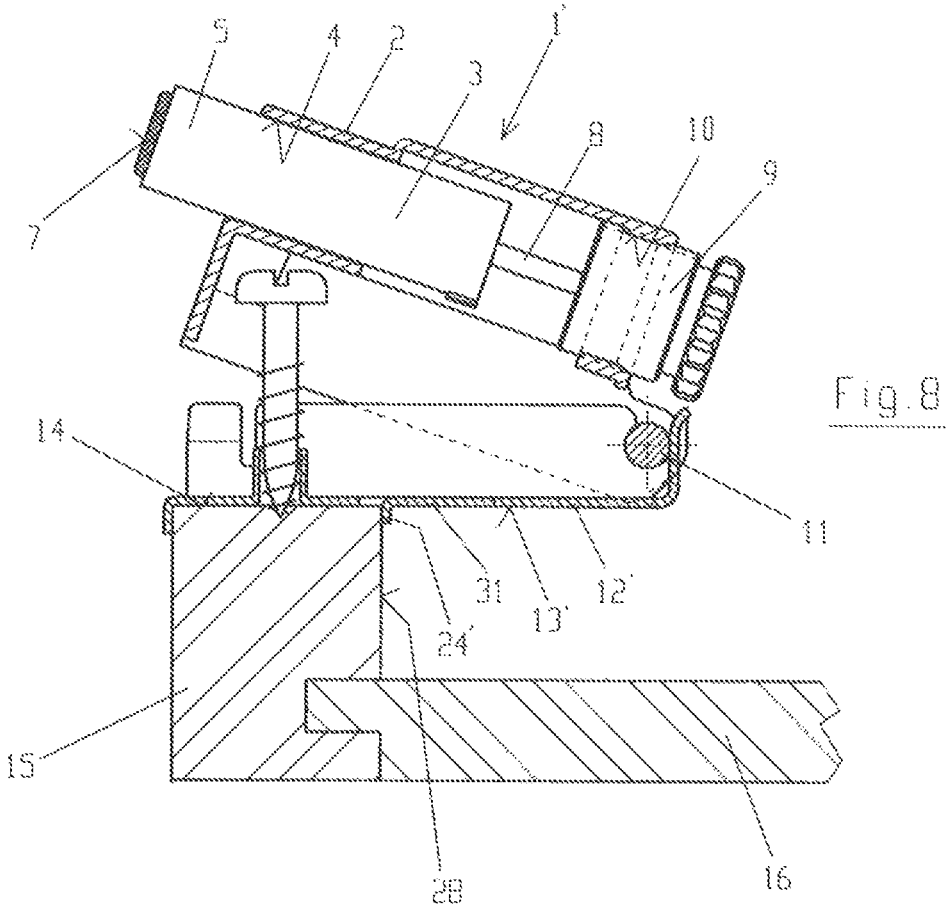

FIGS. 7 and 8 show a modified embodiment of a damping device 1' that is different from the above described embodiment substantially only in that the spring projection 24' is angled off at the free end of a spring tongue 31 that is connected with the base plate 12'. The spring tongue 31 is integrally formed with the base plate 12'. The spring tongue 31 is formed by a substantially U-shaped incision 32 in the base plate 12'.

When the damping device 1' is arranged on a body of a piece of furniture 16 without face frame 16 (FIG. 7) the spring projection 24' is pushed back as described above and no longer extends over the base area 13' of the base plate 12'. A screw sleeve 20' that accommodates the fastening screw 21 in a pre-mounted state is integrally formed with the base plate 12'.

If the damping device 1' is to be fastened to a face frame 15 (FIG. 8) the spring projection 24' protruding from the base area 13 provides a stop for the back 28 of the face frame 15.

The invention claimed is:

1. A damping device for a furniture door leaf, comprising;

a damper accommodating damper housing having a base plate, the base plate having a first side facing towards the damper housing and a second side opposite to the first side;

the second side of the base plate is adapted to be fastened to an effective bearing area of a door opening of the furniture door leaf;

the base plate further comprises a front retaining projection which projects from the second side of the base plate, the front retaining projection is adapted to overlap a face edge of the effective bearing area of the furniture door leaf;

the base plate further comprises a screw bore;

a fastening screw is threaded through the screw bore and adapted to fasten the base plate to the effective bearing area of the furniture door leaf;

the base plate further comprises a spring projection extending from the second side of the base plate;

wherein the damping device is adapted to be mourned on both a door leaf where the effective bearing area is a face frame and a door leaf where the effective bearing area is an inside area of a body of a piece of furniture;

wherein when the damping device is configured for mounting to the face frame, the spring projection extends from the second side of the base plate; and wherein when the damping device is configured for mounting to the inside area of a body of a piece of furniture, the spring projection is pressed against spring resistance to be located on the first side of the base plate.

2. Damping device according to claim 1, wherein the spring projection is angled off at a free end of a spring tongue that is connected with the base plate.

3. Damping device according to claim 2, wherein the spring tongue is integrally formed with the base plate.

4. Damping device according to claim 3, wherein the spring tongue is comprised of a substantially U-shaped incision in the base plate.

5. Damping device according to claim 1, wherein the spring projection is arranged on a plastic insert attached to the base plate.

6. Damping, device according to claim 5, wherein the plastic insert comprises a screw sleeve that provides the screw bore with the screw sleeve being connected to the spring projection via a spring arm.

7. Damping device according to claim 6, wherein the screw bore is adapted to the screw diameter of the fastening screw.

8. Damping device according to claim 6, wherein the spring projection has two spring arms on sides of the spring projection, the two spring arms extending toward the front retaining projection when not deformed.

9. Damping device according to claim 6, wherein the screw sleeve extends into a bore of the base plate.

10. Damping device according to claim 6, wherein the plastic insert is retained between a first support area resting on the screw sleeve and a second support area resting on the spring projection.

11. Damping device according to claim 6, wherein the screw sleeve comprises an upper collar that supports itself on a support edge of the base plate.

* * * * *